United States Patent [19]

Provence, Jr.

[11] Patent Number: 4,889,067

[45] Date of Patent: Dec. 26, 1989

[54] SELF RIGHTING ROAD MARKER

[76] Inventor: Albert M. Provence, Jr., 230 E. Pomona Ave., Monrovia, Calif. 91016

[21] Appl. No.: 317,131

[22] Filed: Feb. 28, 1989

Related U.S. Application Data

[63] Continuation of Ser. No. 93,637, Sep. 8, 1987, abandoned.

[51] Int. Cl.[4] ..... E01F 9/10

[52] U.S. Cl. ..... 116/63 C; 116/63 P; 40/608; 40/612; 248/910

[58] Field of Search ..... 116/63 P, 63 C, 63 T, 116/209; D10/113; 40/606–608, 612; 248/160, 910; 404/10

[56] References Cited

U.S. PATENT DOCUMENTS

| | | | |
|---|---|---|---|
| 782,811 | 2/1905 | Ames | 40/607 |
| 2,333,273 | 11/1943 | Scanlon | 116/209 |
| 2,817,308 | 12/1957 | Scanlon | 116/63 R |
| 3,383,409 | 6/1968 | Dawson | 40/612 |
| 3,732,842 | 5/1973 | Vara, Sr. | 116/63 P |
| 3,792,679 | 2/1974 | Duckett et al. | 116/63 C |

FOREIGN PATENT DOCUMENTS

| | | | |
|---|---|---|---|
| 819373 | 8/1969 | Canada | 40/3 |

*Primary Examiner*—William A. Cuchlinski, Jr.
*Assistant Examiner*—W. Morris Worth
*Attorney, Agent, or Firm*—Cahill, Sutton & Thomas

[57] ABSTRACT

A normally upstanding road marker including a conical body is provided with a special base formed of an elastomeric material for inducing self-righting movements to return the road marker to an upstanding position subsequent to its having been tipped over. The base is provided with a peripheral edge of undulatory configuration which allows the base to be large enough to induce the self-righting movements without being excessively heavy.

8 Claims, 1 Drawing Sheet

SELF RIGHTING ROAD MARKER

This is a continuation of application Ser. No. 093,637, filed Sept. 8, 1987, now abandoned.

BACKGROUND OF THE INVENTION

1. Field of the Invention

The present invention relates in general to temporary road marking devices, and more particularly to an improved road marker having self-righting characteristics for returning it to an upright position subsequent to the application of externally applied tipping forces.

2. Description of the Prior Art

Road markers, or traffic cones as they are commonly referred to in the art, are in wide usage for temporarily delineating obstructions. Traditionally, traffic cones have been in the form of upstanding hollow cones having planar bases that are slightly larger than the bottom ends of the cones to provide a degree of stability. Traffic cones are normaly fabricated of a brightly colored synthetic resin and are ideally light in weight for portability and most importantly so that they will yield in reaction to externally applied forces rather than for example, damage an automobile which hits such a traffic cone.

For these reasons, traditional traffic cones are easily tipped over by a striking vehicle and even by the wind. Due to the relatively small size of the base and the semi-rigid nature of the materials used in fabricating the traditional traffic cones, once they are tipped oer they remain that way and can cause a hazardous situation due to the significant loss of visibility of the tipped over traffic cone.

As a result of the tipping problem, some attempts have been made to devise an acceptable traffic cone which is more resistant to tipping over as a result of externally applied tipping forces. One way of doing this which has been suggested is to fabricate the cones with larger and weighted bases. Such traffic cones did not achieve any degree of commercial success due to the increased fabrication costs associated with weighting of the bases, and due to the significant loss of portability and ease of handling.

As disclosed in U.S. Pat. No. 3,792,679, another prior art attempt was made to overcome the tipping problem associated with the traditional traffic cones. This particular attempt suggested that the cones be fabricated of a material having elasticity and flexibility characteristics so that the cones would tend to be self-righting, that is, they would return to an upright position after being tipped over. This particular prior art structure failed to achieve any appreciable degree of commercial acceptance for the same basic reason mentioned above. In order for this particular prior art structure to work properly, the base has to be large enough so that a portion thereof will remain in contact with the ground surface at all times during tipping and self righting movements. In the absence of a maintained ground surface contact, the traffic cone will remain in a tipped over state and will not right itself. The added weight of a base that is sufficiently large enough to accomplish this, reduced the portability and ease of handling of the particular prior art structure, and this contributed to its lack of success.

Therefore, a need exists for a new and improved traffic cone structure which overcomes some of the problems and shortcomings of the prior art.

SUMMARY OF THE INVENTION

In accordance with the present invention, a new and improved road marker, or traffic cone, is disclosed for temporarily delineating obstructions such as road repair work, with the traffic cone being a relatively lightweight self-righting structure. The traffic cone includes the usual substantially conical hollow body with an especially configured base that provides the above mentioned desirable characteristics. The base extends from and surrounds the circular bottom of the cone and has a peripheral surrounding edge of undulating configuration which provides the base with an alternating array of radially disposed protruding flaps and grooves. The base is fabricated from a suitable elastomeric synethetic resin, such as polyvinylchloride having a plasticizor, so as to have elasticity and flexibility for returning the traffic cone to the upright position after it has been subjected to externally applied tipping forces. The undulating peripheral edge of the base provides the base with sufficient size so that a portion of the base, i.e. at least two and preferably three of the radial flaps, will maintain the necessary ground surface contact during the tipping and self-righting movements, without the base being unduly heavy.

Accordingly, it is an object of the present invention to provide a new and improved road marker, or traffic cone.

Another object of the present invention is to provide a new and improved traffic cone which is of special configuration so as to return itself to an upstanding position after being tipped over with the traffic cone being of relatively light weight to maintain the desired portability and ease of handling.

Another object of the present invention is to provide a new and improved self-righting lightweight traffic cone including the usual conical body having a special base which is formed of a suitable elastomeric material to provide the base with flexibility and elasticity to provide the self-righting characteristic, and has an undulating peripheral edge for minimization of the weight of the traffic cone.

Still another object of the present invention is to provide a lightweight self-righting traffic cone of the above described character wherein the undulating peripheral edge of the base provides an alternating array of radially protruding flaps and grooves with at least two, and preferably three of the flaps maintaining ground surface contact during tipping and self-righting movements, and the grooves providing a base of minimal weight.

The foregoing and other objects of the present invention as well as the invention itself, may be more fully understood from the following description when read in conjunction with the accompanying drawings.

DESCRIPTION OF THE PREFERRED EMBODIMENT

Figure 1:
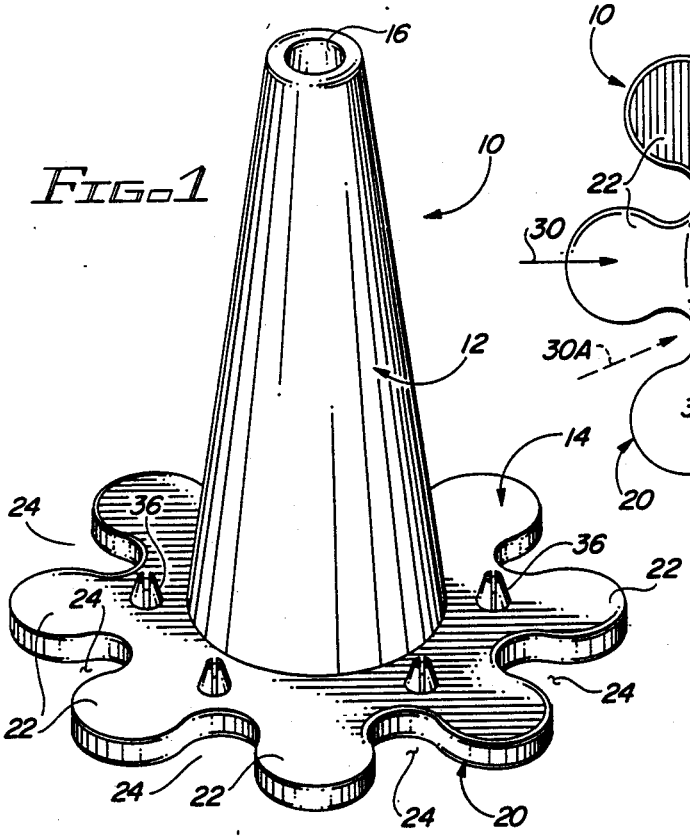
FIG. 1 is a perspective view of the self-righting road marker, or traffic cone, of the present invention.

Referring more particularly to the drawings, FIG. 1 best shows the road marker of the present invention which is indicated in its entirety by the reference numeral 10. As will hereinafter be described in detail, the road marker, or traffic cone as it is commonly referred to in the art, includes an upright substantially conical body 12 with an especially configured base 14.

The body 12 is a thin wall hollow structure of frusto-conical configuration having a hole 16 in its upper end and defining a circular open bottom end 18. The substantially conical body 12 is preferably formed of a suitable lightweight semi-rigid synthetic resin such as ethylene vinyl acetate. As an alternative, the substantially conical body 12 can be formed of essentially the same material as the base 14 which, as will be described has special characteristics. The material of the cone 12 may be similar to the material of the base 14 except that it should be lighter in weight such as by using a lighter weight filler in the conical body material. In any event the conical body 12 is joined to the base by using a suitable adhesive molding the base 14 in place on a previously molded cone body 12, or the like.

In any case, the base 14 is integral with, or attached to the conical body 12 so as to extend from the open circular bottom end 18 in surrounding relationship therewith and disposed to lie in a plane which is normal with respect to the longitudinal axis of the substantially conical body 12.

A principle object of the present invention is to provide the traffic cone 10 with the ability of returning to an upright position subsequent to its having been tipped over by an externally applied force such as being struck by an automotive vehicle, blown over by strong winds and the like. This objective is accomplished by a combination of physical characteristics and the special material which is used in forming the base 14.

The base 14 is fabricated from an elastomeric material which provides the base with flexibility and elasticity characteristics which causes the base to have an elastic memory so that it will tend to return to its normal planar shape after being pushed, deflected or otherwise forced out of its normal shape and disposition. A material which is suitable for this purpose is polyvinylchloride (PVC) formulated with a plasticizer along with other known constituents such as a heat stabilizer, ultraviolet inhibitor and the like.

As will be appreciated, traffic cones per se need to have a base which is large enough and heavy enough to maintain sufficient stability during normal use. In order for a traffic cone having an elastomeric base to possess the desired self-righting characteristics, the base must be larger, i.e. have greater surface extent, in comparision to a traditional non-self-righting traffic cone, to provide what may be defined as an effective surface area of the base. The effective surface area of the base of the traffic cone is defined as that portion, or area of the base which remains in contact with the ground surface during tipping and self-righting movements of the traffic cone.

Figure 2:
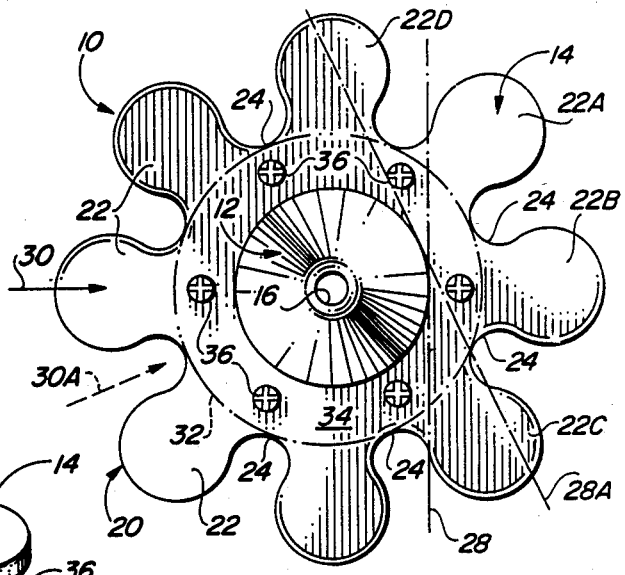
FIG. 2 is an enlarged plan view of the traffic cone of the present invention.

As seen best in FIG. 2, the base 14 is formed with an undulating peripheral edge 20 in accordance with the present invention, to provide the traffic cone 10 with specific advantages which relate to its stability, self-righting characteristics and its base to cone weight ratio. The undulating peripheral edge 20 of the base 14 is configured to form an alternating array, or series, of radially protruding flaps 22 and grooves 24 which increases the effective surface area of the base 14 without increasing its weight, or alternatively reduces the weight of the base without a loss of effective surface area. The undulating peripheral edge 20 is shown as being of substantially sinusoidal configuration but it could be of other shapes such as a square wave. In otherwords, the protruding radial flaps 22 could be formed with opposed substantially parallel side edges and an end edge with similarly configured grooves.

Figure 3:
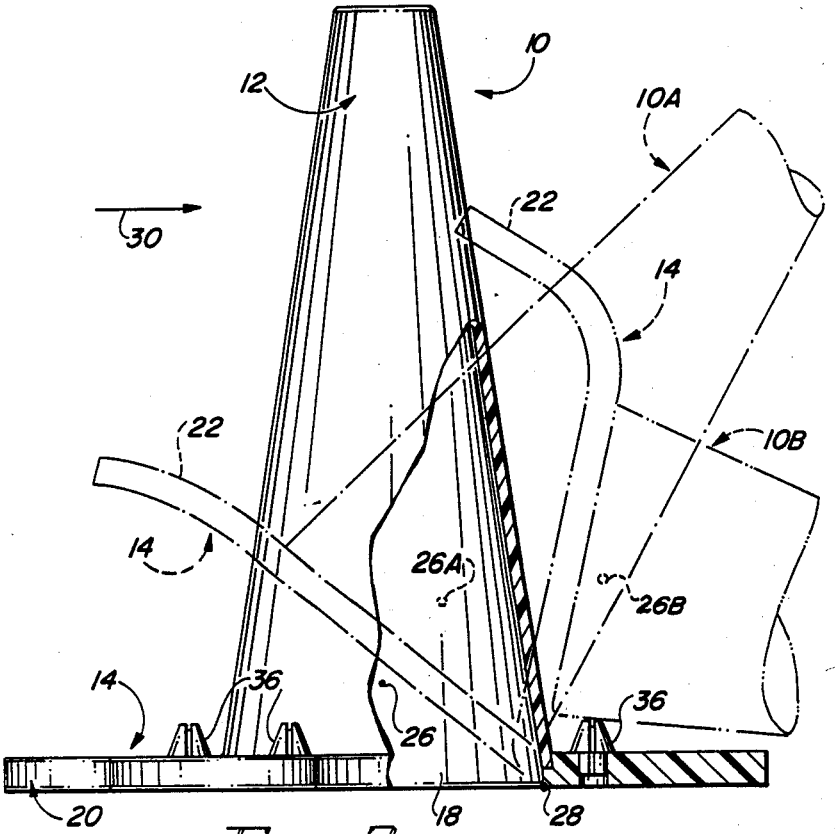
FIG. 3 is a side elevational view of the traffic cone of the present invention with a portion thereof being broken away to show the various features thereof.

With particular reference to FIGS. 2 and 3, the traffic cone 10 is shown as having a relatively low center of gravity 26 which will tend to move in an arcuate path about a pivot axis 28 when the traffic cone 10 is subjected to a tipping force as is dictated by the arrow 30. Due to the elasticity and flexibility of the base 14, the effective surface area, which remains in contact with the ground surface, will be that portion of the base's area which is on the side of the pivot axis 28 which is opposite to the applied tipping force 30. It has been found that at least two, and preferably three, of the radially protruding flaps 22 need to remain in ground surface engagement to provide an ideal amount of effective surface area of the base 14. This can be achieved in the manner shown best in FIG. 2. When the tipping force is applied in the direction of the forced arrow 30, the flaps 22A, 22B and 22C will constitute the effective surface area of the base 14 due to their being disposed oppositely of the applied force i.e. on the opposite side of the pivot axis 28. When the tipping force is applied in another direction as indicated by the force arrow 30A, the pivot axis 28A will be moved appropriately with the direction change of the applied force, and the radial flaps 22A, 22B, and portions of the adjacent flaps 22C and 22D will make up the effective area of the base.

Referring once again to FIG. 3, when the traffic cone 10 is in a partially tipped over position as indicated by the dashed line position 10A thereof, the center of gravity 26 will shift into the position 26A which is an "under center" position relative to the pivot axis 28. In situations of this sort, gravity will return the traffic cone 10A to its normal upright position. In instances where the tipping force is great enough to fully tip the traffic cone, as indicated by the dashed line 10B in FIG. 3, the center of gravity 26B will move to an "over center" position relative to the pivot axis 28. When fully tipped, the radial flaps 22 which are diametrically opposed to the effective surface area of the base 14, will bend back as shown, in the direction opposite to the applied tipping force. The bent back flaps 22 and the elastic memory, or resiliency, of the base cooperate to return the traffic cone 10 to its normal upright position.

As indicated by the dash line circle 32 in FIG. 2, the special base 14 of the present invention may be divided into two portions both of which are concentric with respect to the circular bottom end 18 of the frusto-conical cone 12. The first of these concentric base portions is a inner concentric area 34 of toroidal shape with the second being an outer concentric area which includes the alternating series of radial flaps 22 and grooves 24. In order for the traffic cone 10 to have the necessary effective area wherein at least two and preferably three of the flaps 22 are in ground surface contact during tipping and self-righting movements, it has been determined that eight equally spaced flaps 22 accomplishes that objective, and that the eight flaps constitute approximately half of the total area of the outer concentric portion of the base 14.

Figure 4:
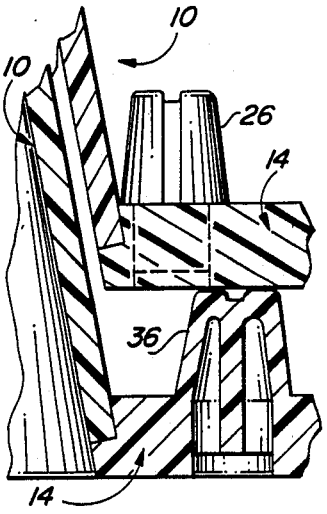
FIG. 4 is an enlarged fragmentary sectional view of portions of two traffic cones of the present invention which are shown in stacked relationship.

In addition to the foregoing, the traffic cone 10 may also be provided with a plurality (six shown) of standoffs 36 which are formed integrally, or suitably joined to the base 14. The standoffs 36 are disposed in circumferentially equally spaced increments in the inner concentric area 34 of the base 14, and extend upwardly therefrom. As shown in FIG. 4, the standoffs 36 are for use whenever the traffic cones 10 are stacked as is customary in storage and transport of the cones. The standoffs 36 of a lower traffic cone will support the traffic cone which is immediately above it in the stack, in an upwardly spaced position to prevent sticking of the stacked traffic cones.

While the principles of the invention have now been made clear in the illustrated embodiments, there will be immediately obvious to those skilled in the art, many modifications of structure, arrangements, proportions, the elements, materials and components used in the practice of the invention and otherwise, which are particularly adapted for specific environments and operation requirements without departing from those principles. The appended claims are therefore intended to cover and embrace any such modifications within the limits only of the true spirit and scope of the invention.

What I claim is:

1. A self righting marker having a flexible base for urging said marker into an upright position after lateral tilting of said marker, said marker comprising in combination:

(a) a generally cone shaped hollow body for providing a visually perceivable marker, said body including an upper end and a lower end;

(b) a resilient and flexible base for biasing said body into an upright position, said base including:

(i) an inner concentric base for engaging and retaining the lower end of said body; and (ii) a flexible outer concentric base responsive to tilting of said body for biasing said body into the upright position, said outer concentric base including a plurality of resilient and flexible flaps interleaved by grooves for reducing the weight of said base while increasing the effective surface area of said base in contact with the ground during tilting of said marker.

2. The marker as set forth in claim 1 wherein each of said flaps is of reduced width in the plane of said base proximate said inner concentric base to focus flexure of said base proximate the perimeter of said inner concentric base.

3. The marker as set forth in claim 2 where the perimeter of each of said flaps is smoothly curved.

4. A self righting marker having a flexible base for urging said marker into an upright position after lateral tilting of said marker, said marker comprising in combination:

(a) a generally cone shaped hollow body for providing a visually perceivable marker, said body including an upper end and a lower end;

(b) a resilient and flexible planar base for biasing said body into an upright position after tilting of said marker, said base including:

(i) an inner annular base for engaging and retaining the lower end of said body and for resiliently flexing upon tilting of said marker;

(ii) an outer base concentric with said inner base for reducing the weight of said base while increasing the effective surface area of said base, said outer base including an undulating peripheral edge for defining a series of flaps and grooves, said flaps and grooves being radially oriented about said cone shaped hollow body, said outer base including a sufficient number of said flaps to position at least two of said flaps laterally outwardly of an imaginary line drawn across said base tangent to said cone shaped hollow body at the junction of said cone shaped hollow body and said inner annular base.

5. The self righting marker as set forth in claim 4 wherein the total area of said flaps positioned laterally outwardly of the imaginary line is at least equal to the total area of two of the flaps.

6. The self righting marker as set forth in claim 4 wherein said flaps comprise one half of the area of said outer base, which area is defined as existing between a first imaginary circular line interconnecting the radial extremity of each of said flaps and a second imaginary circular line interconnecting a base portion of each of said flaps.

7. The self righting marker as set forth in claim 4 wherein said base includes eight of said flaps equiangularly spaced about said body.

8. The self righting marker as set forth in claim 4 wherein said undulating peripheral edge comprises a substantially sinusoidal configuration superimposed upon an imaginary circular line.

* * * * *